US009903632B2

(12) United States Patent
Visin

(10) Patent No.: US 9,903,632 B2
(45) Date of Patent: Feb. 27, 2018

(54) ICE WELL DIVERTER WEDGE FOR ICE CONTAINER

(71) Applicant: WHIRLPOOL CORPORATION, Benton Harbor, MI (US)

(72) Inventor: Jerold M. Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/350,357

(22) Filed: Nov. 14, 2016

(65) Prior Publication Data

US 2017/0059222 A1 Mar. 2, 2017

Related U.S. Application Data

(63) Continuation of application No. 13/747,693, filed on Jan. 23, 2013, now Pat. No. 9,523,528.

(51) Int. Cl.

| | |
|---|---|
| ***F25C 5/18*** | (2006.01) |
| ***F25C 5/04*** | (2006.01) |
| ***F25C 5/00*** | (2018.01) |

(52) U.S. Cl.

CPC ..... *F25C 5/046* (2013.01); *F25C 5/005* (2013.01); *F25C 2400/04* (2013.01); *F25C 2400/08* (2013.01); *F25C 2400/10* (2013.01)

(58) Field of Classification Search

CPC .... F25C 5/02; F25C 5/18; F25C 5/182; F25C 5/043; F25C 5/046

USPC ..... 62/320, 340, 344; 241/DIG. 17

See application file for complete search history.

(56) References Cited

U.S. PATENT DOCUMENTS

| | | | |
|---|---|---|---|
| 4,972,999 | A | 11/1990 | Grace |
| 6,952,936 | B2 | 10/2005 | Sannasi et al. |
| 7,111,473 | B2 | 9/2006 | Chung et al. |
| 7,631,513 | B2 | 12/2009 | Chung et al. |
| 2006/0086127 | A1 | 4/2006 | Anselimno et al. |
| 2006/0248912 | A1 | 11/2006 | Park et al. |
| 2007/0084230 | A1 | 4/2007 | Krause et al. |
| 2008/0134709 | A1 | 6/2008 | Fischer et al. |
| 2008/0156016 | A1 | 7/2008 | Jeong et al. |
| 2008/0156826 | A1 | 7/2008 | Kim et al. |

(Continued)

OTHER PUBLICATIONS

NPL 1—Definition of "divert" provided by Google define.*
NPL 2—Definition of 'at' provided by Merriam-Webster.*

*Primary Examiner* — Jianying Atkisson
*Assistant Examiner* — Antonio R Febles

(57) ABSTRACT

A refrigerator is provided including an ice making assembly. The ice making assembly includes a storage container that has a discharge zone including a crushing assembly for selectively crushing formed ice before dispensing the ice through the dispenser of the refrigerator. The crushing assembly includes both rotating and fixed crushing blades, and including crushing teeth for crushing the formed ice cubes therebetween. A diverter wedge may be positioned at or formed integrally with the fixed crushing blades such that the diverter wedge closes any gap between the rotating blades and the wall of the discharge zone. The diverter wedge can include a sloped portion to move any smaller or differently-shaped cubes from the outer edge of the discharge zone to between the crushing blades such that it is ensured that the cubes are crushed before being dispensed.

20 Claims, 7 Drawing Sheets

(56) References Cited

U.S. PATENT DOCUMENTS

| | | | |
|---|---|---|---|
| 2009/0133428 | A1 | 5/2009 | An et al. |
| 2010/0218538 | A1 | 9/2010 | Buchstab et al. |
| 2010/0287959 | A1 | 11/2010 | Kim et al. |
| 2010/0313593 | A1 | 12/2010 | Lee et al. |
| 2011/0048052 | A1 | 3/2011 | Lee et al. |
| 2011/0067429 | A1 | 3/2011 | Lee et al. |
| 2011/0138863 | A1 | 6/2011 | Kim et al. |
| 2011/0146324 | A1 | 6/2011 | Lee et al. |
| 2011/0146331 | A1 | 6/2011 | Moon et al. |
| 2013/0042644 | A1 | 2/2013 | Mitchell |

* cited by examiner

ICE WELL DIVERTER WEDGE FOR ICE CONTAINER

CROSS-REFERENCE TO RELATED APPLICATIONS

This application is a Continuation Application of U.S. Ser. No. 13/747,693, filed on Jan. 23, 2013, the entire disclosure of which is expressly incorporated herein by reference.

FIELD OF THE INVENTION

The present invention relates generally to refrigerators. More particularly, but not exclusively, the invention relates to a crushing assembly of an ice container of a refrigerator that is configured to mitigate or prevent ice cubes from passing through the crushing assembly uncrushed.

BACKGROUND OF THE INVENTION

Bottom mount refrigerators include a freezer compartment on the bottom, with the fresh food or refrigerator compartment above the freezer compartment. One or more doors provide access to the fresh food compartment, and a separate door provides access to the freezer compartment. The freezer door or doors may be drawer-type doors that are pulled out, or they may be hingedly connected similar to the refrigerator compartment doors, such that they are rotated to provide access within.

Ice makers may be included with the refrigerators. In general, the ice maker includes a water source, a cooling source, a mold, and an ejecting mechanism. Water is added to the mold, and the cooling source removes heat from the water to lower the temperature below freezing, at which time ice cubes are formed. Once the cubes have formed, the ejecting mechanism operates to remove or eject the formed cubes from the molds, at which point new water can be added and the process repeated.

The ejected ice cubes are generally directed towards an ice container or ice storage bin. The ice container is located generally adjacent to the ice maker so that the formed ice cubes do not have to travel a long distance from the ice maker. Furthermore, the cooled air of the cooling source may be used to direct cold air to the ice container to keep the ice cubes in the ice container below freezing to prevent the cubes from melting. The ice container may include an optional ice crushing assembly positioned either in or adjacent the ice container. The ice crushing assembly is used to crush the formed ice cubes during or prior to dispensement from a dispenser of the refrigerator.

With traditional ice crushing assemblies, there is a fixed set of crushing blades and a set of rotating crushing blades. The crushing blades are configured for a crescent-shaped ice cube. When the desire for different shapes and sizes of ice cubes arise, there is a problem crushing smaller cubes with the existing ice crushing set-up. As the rotating crushing blades do not generally extend to the outer perimeter of the ice container, there can exist a gap between the rotating crushing blades and the perimeter. On occasion, smaller ice cubes have the capability of passing through the crusher blades on the outer perimeter of the ice container without being crushed.

Therefore, there exists a need in the art for an improved ice crushing assembly that can be used with any size or shape of formed ice cubes to ensure that the ice cubes are crushed by the assembly, when the crushing method has been selected.

SUMMARY OF THE INVENTION

Therefore, it is a primary object, feature, and/or advantage of the present invention to provide an apparatus that overcomes the deficiencies in the art.

It is another object, feature, and/or advantage of the present invention to provide a crushing assembly that ensures that all sizes and shapes of ice cubes are crushed by a crushing assembly.

It is yet another object, feature, and/or advantage of the present invention to provide a diverter wedge near the fixed crusher blades of an ice crushing assembly to move the ice cubes toward the rotating crusher blades.

It is still another object, feature, and/or advantage of the present invention to provide an item that can be added or removed to an ice crushing assembly based upon the configuration of ice cubes formed by an ice maker of the refrigerator.

It is a further object, feature, and/or advantage of the present invention to provide crusher blades for an ice crushing assembly that include a diverter section.

It is still a further object, feature, and/or advantage of the present invention to provide an ice container with an improved ice crushing assembly.

It is yet a further object, feature, and/or advantage of the present invention to provide a more efficient ice crushing assembly to work with a more universal selection of ice cube geometries.

These and/or other objects, features, and advantages of the present invention will be apparent to those skilled in the art. The present invention is not to be limited to or by these objects, features and advantages. No single embodiment need provide each and every object, feature, or advantage.

According to an aspect of the invention, a refrigerator is provided. The refrigerator includes a cabinet, and an ice container positioned within the cabinet. A crushing assembly is operatively connected to the ice container. The crushing assembly comprises a plurality of fixed crushing blades, a plurality of rotating crushing blades positioned adjacent the fixed crushing blades, and a diverter wedge positioned at an edge of the fixed crushing blades configured to divert cubes towards the crushing blades.

The diverter wedge is included to aid in the crushing method of the crushing assembly. The wedge, which can be a separate component or formed integrally with the fixed crushing blades, provides a wedge-like member to kick or manipulate ice cubes towards the rotating crusher blades such that the ice cubes will not pass through the crushing assembly without being crushed. Therefore, the diverter wedge allows the ice crushing assembly to be used with generally any size, shape, or geometry of ice cube to ensure that the cubes are crushed, when so selected.

According to another aspect of the invention, a refrigerator is provided. The refrigerator includes a cabinet, at least one compartment within the cabinet, at least one door providing access to within the compartment, an icemaker positioned within the compartment, and an ice container positioned adjacent the icemaker. A crushing assembly is positioned within the ice container and comprises a plurality of fixed blades and a plurality of rotating crushing blades alternated in the container. The plurality of fixed blades includes a diverter wedge positioned at an edge of the fixed blades configured to divert cubes towards the crushing blades.

According to yet another aspect of the invention, an ice container is provided. The ice container includes a storage area defined by a floor and walls extending from the floor.

A crushing assembly is positioned within the storage area, and comprises a plurality of fixed blades and a plurality of rotating crushing blades alternated along the height of the assembly. A diverter wedge extends along the height of the blades and positioned at an edge of the fixed blades configured to divert cubes towards the crushing blades.

DETAILED DESCRIPTION OF THE PREFERRED EMBODIMENTS

Figure 1:
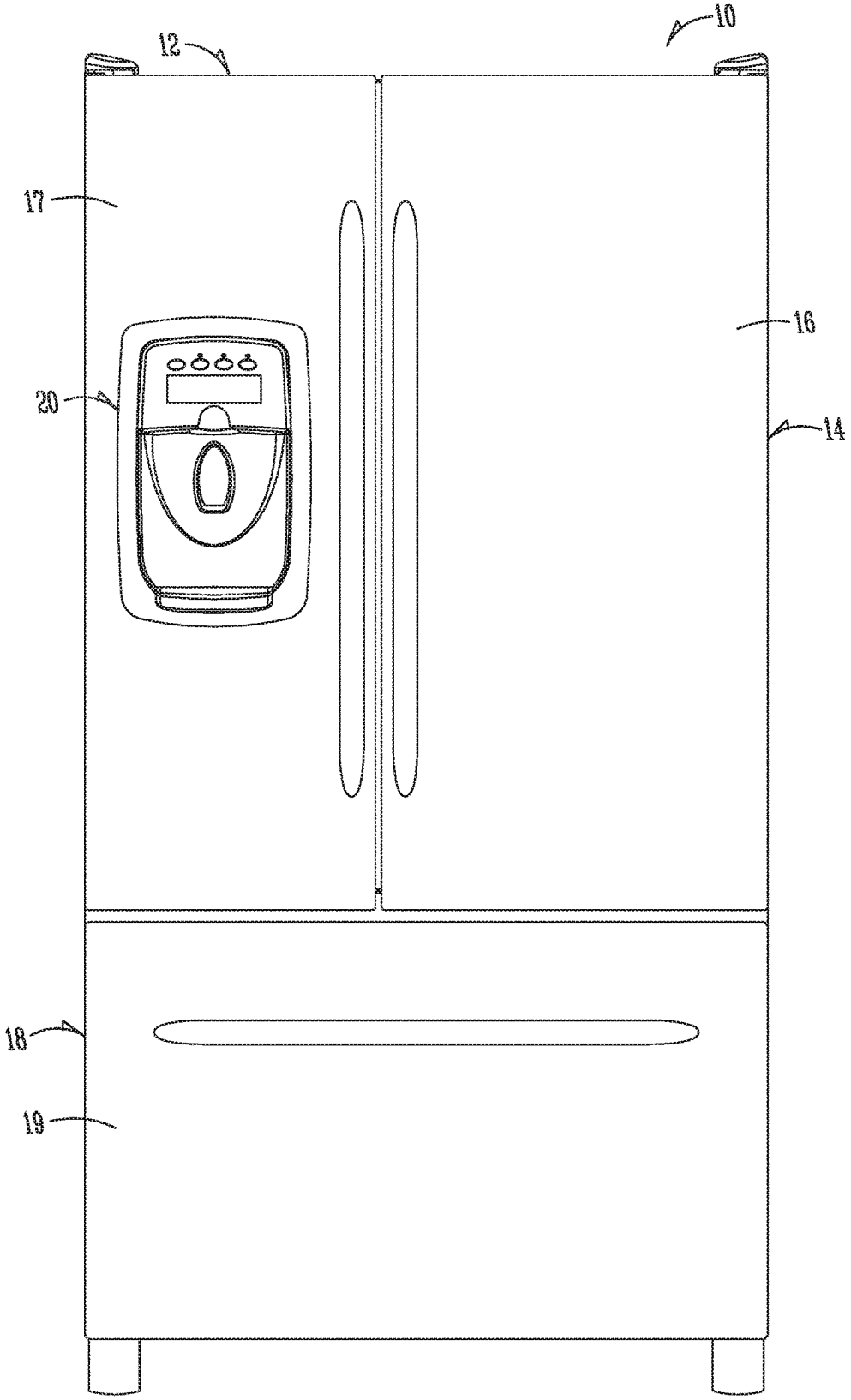
FIG. 1 is a front elevation view of a bottom mount refrigerator.

FIG. 1 is a front elevation view of a bottom mount refrigerator 10. The bottom mount refrigerator 10 includes a cabinet 12 encapsulating the compartments of the refrigerator 10. As shown in FIG. 1, the upper compartment is a refrigerator or fresh food compartment 14. First and second doors 16, 17 provide access to the interior of the refrigerator compartment 14. A dispenser 20 is positioned on one of the doors 16, 17 of the refrigerator compartment 14. The dispenser 20 may be a water dispenser, ice dispenser, other beverage dispenser, or some combination thereof. Furthermore, the dispenser 20 may be placed on any door of the refrigerator 10, or the dispenser 20 may be placed within one of the compartments of the refrigerator 10. For example, the dispenser 20 may be placed at one of the interior walls of the refrigerator compartment 14, thus being part of the cabinet 12. The placement of the dispenser 20 is not to limit the present invention.

Positioned generally below the refrigerator compartment 14 is a freezer compartment 18. The freezer compartment 18 is generally set to be at or below zero degrees Fahrenheit, while the refrigerator compartment 14 is set to be at a warmer temperature so as to prevent freezing of the items stored therein. A freezer door 19 provides access to within the freezer compartment 18. The freezer door 19 of FIG. 1 is shown to be a drawer type door. However, the present invention contemplates that the freezer door 19 may be a drawer, a hinged door, multiple doors or drawers, or some combination thereof.

It should also be appreciated that while the figures show a bottom mount style refrigerator 10, the present invention contemplates that any style of refrigerator may be included as part of the invention. The figures merely depict examples of a type of refrigerator that can be used with the present invention. For example, additional drawers or compartments, such as pantry compartments, may be included below, above, or between the refrigerator and freezer compartments shown in FIG. 1. In addition, other types of compartments, as well as other types of refrigerators, are intended to be included as part of the present invention.

Figure 2:
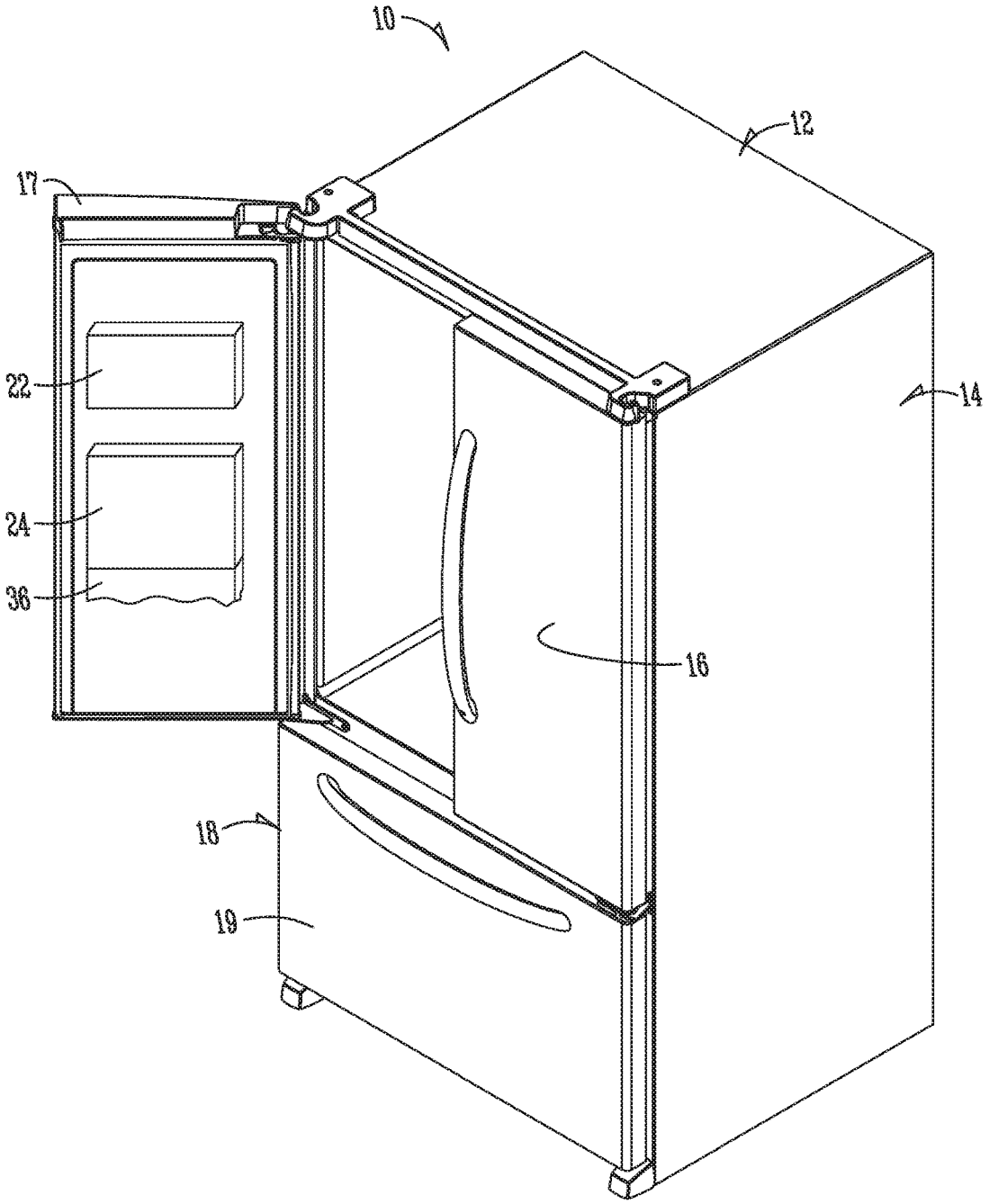
FIG. 2 is a perspective view of the refrigerator of claim 1, with doors opened to show an interior of the refrigerator.

FIG. 2 is a perspective view of the refrigerator 10 of FIG. 1 having the refrigerator door 17 opened and the refrigerator door 16 closed to show a partial interior of the refrigerator 10 and interior portion of the door 17. Positioned on the interior of the door 17 are an ice maker 22 and ice container 24. The ice maker 22 may be any type of ice maker as is known in the art. Therefore, the ice maker 22 is connected to a water source, such that water is directed to the ice maker 22. The water stored in ice molds of the ice maker 22 is then cooled to remove heat therefrom to form ice. The formed ice of the ice maker 22 is then ejected into the ice container 24. Furthermore, at the lower end or a portion of the ice container 24 may be a discharge zone 36. The discharge zone 36 can be connected to the dispenser 20 shown in FIG. 1. Therefore, ice stored and contained in the ice container 24 can be discharged through the discharge zone 36 and dispensed out of the dispenser 20.

Figure 3:
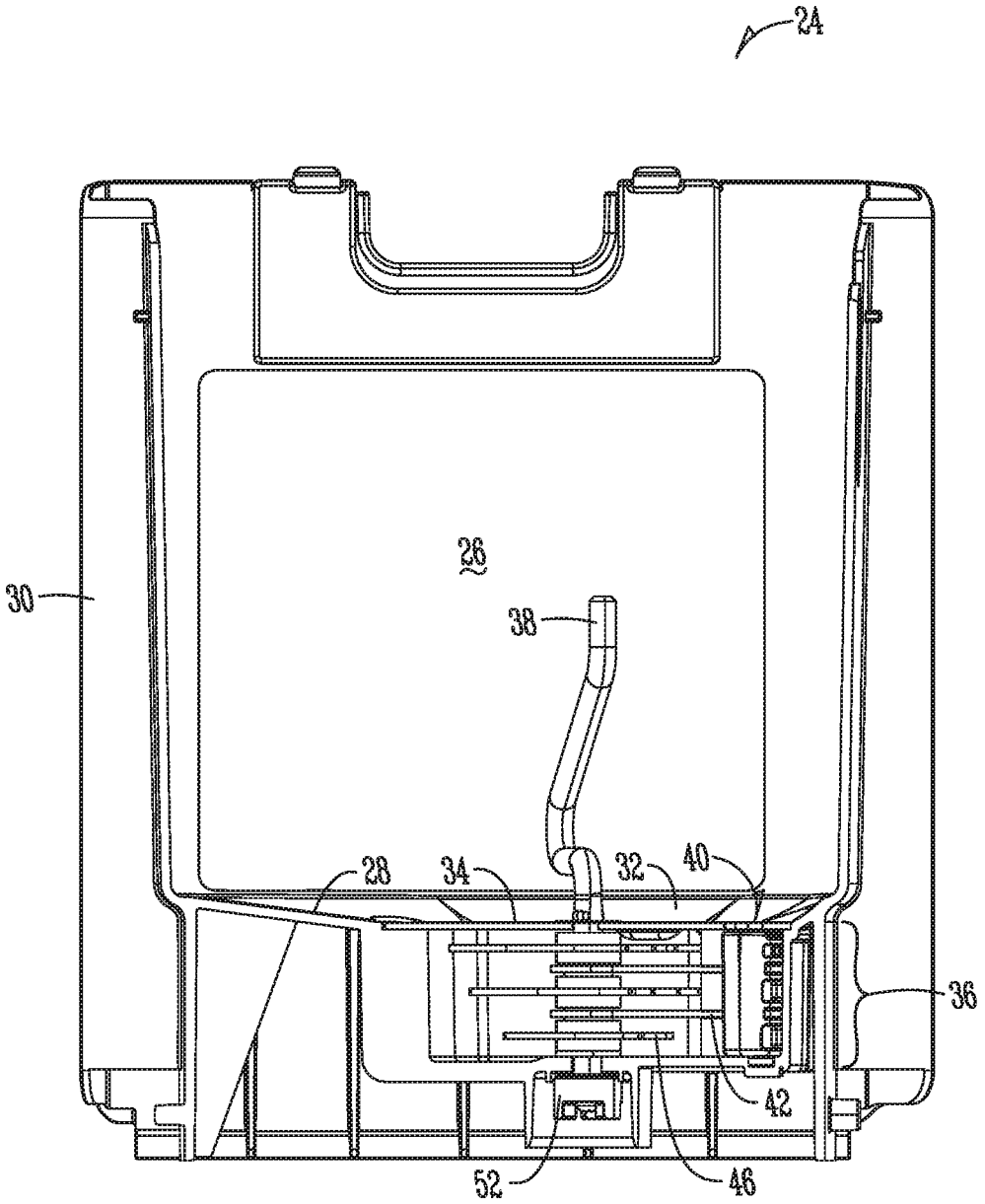
FIG. 3 is a side sectional view of an ice container having an ice crushing assembly therein.
Figure 4:
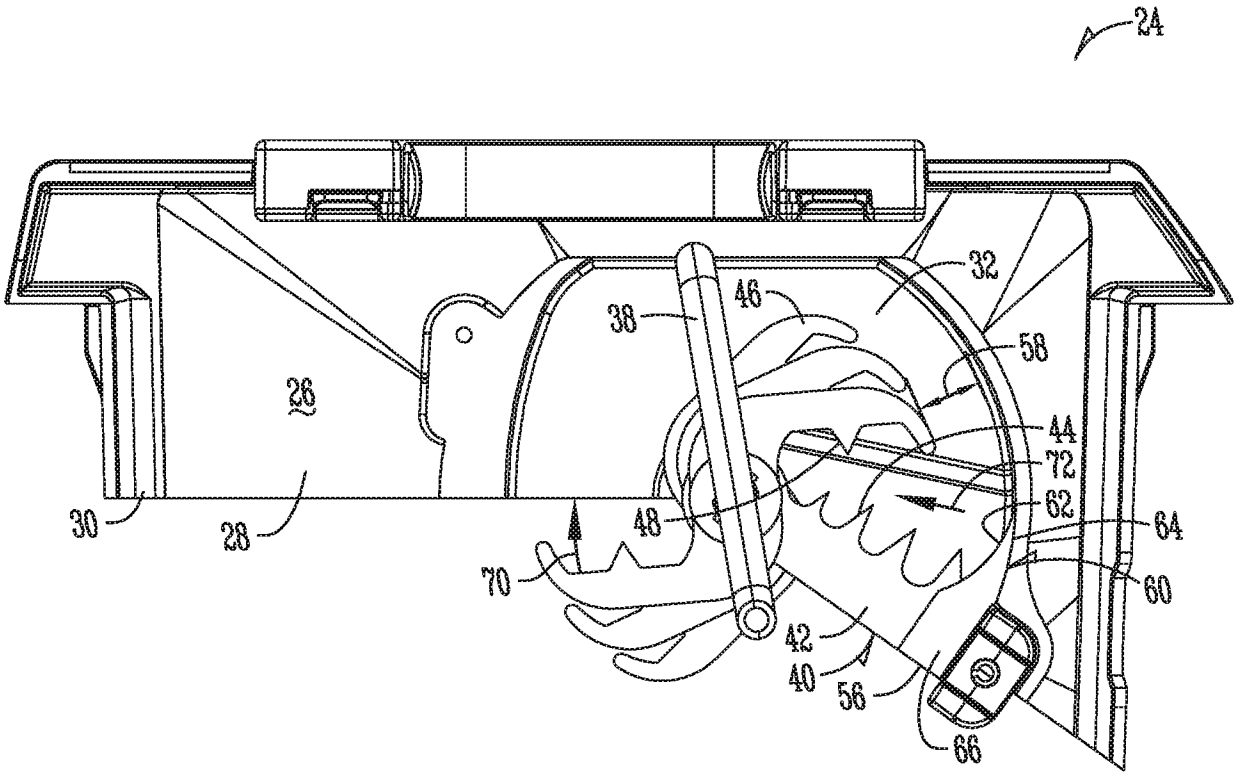
FIG. 4 is a top plan view of an ice crushing assembly according to an embodiment of the present invention.
Figure 5:
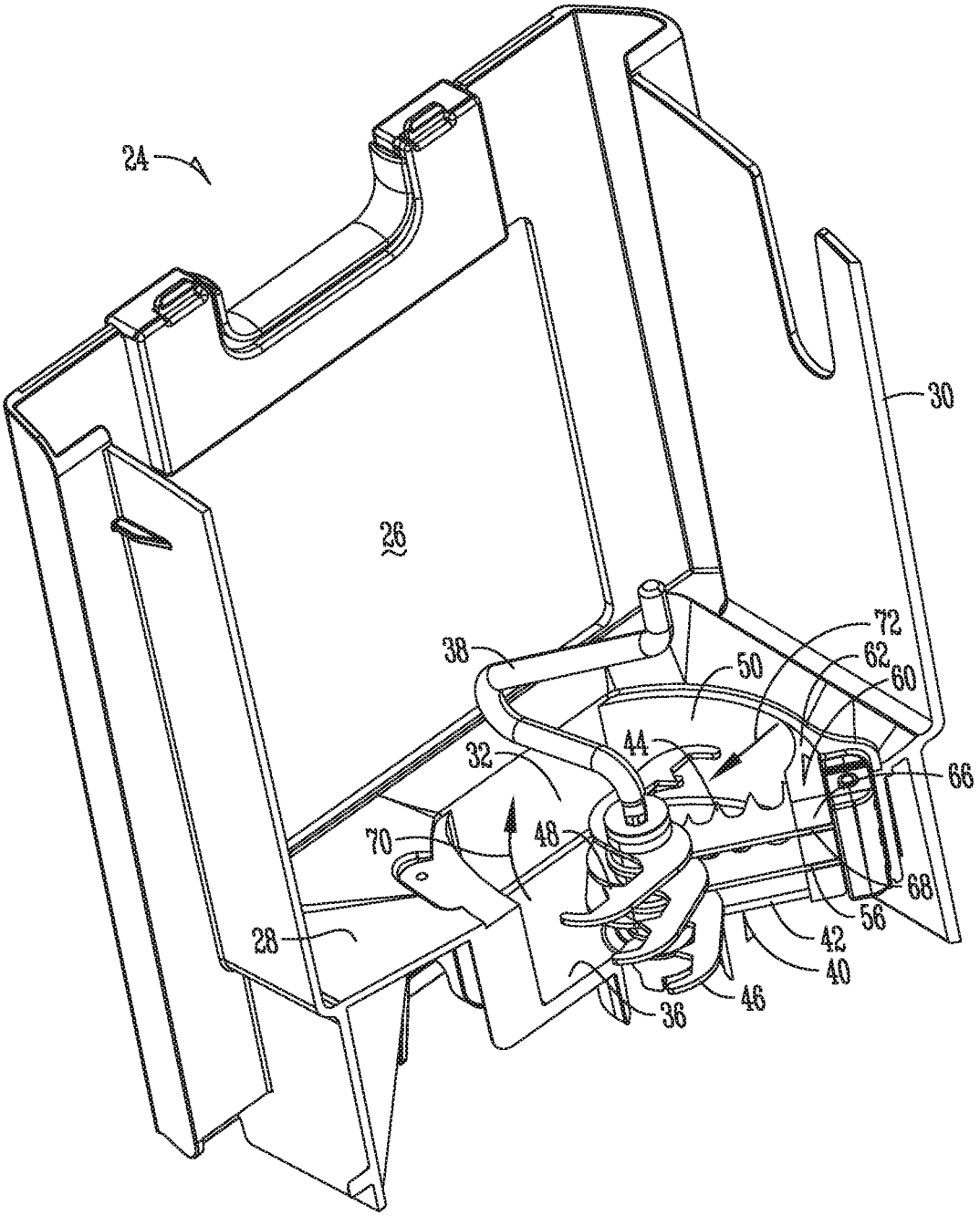
FIG. 5 is a perspective sectional view of the ice crushing assembly shown in FIG. 4.

FIGS. 3-5 are sectional views of an ice container 24 including a crushing assembly 40 according to an aspect of the present invention. The ice container 24 shown in FIGS. 3-5 includes generally a storage area 26 defined by a floor 28 and a plurality of walls 30 extending generally upward from floor 28. The ice container 24 may comprise generally any shape and size, and can be configured accordingly to work with any type of refrigerator to provide a large storage area 26 for containing ice, while not extending into the refrigerator compartment 14 such that the refrigerator compartment 14 maintains a large storage capacity. An ice aperture 32 is formed through at least a portion of the floor 28 of the ice container 24. An aperture cover or lid 34 may be positioned at the aperture 32. The aperture cover or lid 34 may include an aperture therethrough to allow ice to selectively be passed from the storage area 26 and into the discharge zone 36, which includes the crushing assembly 40. Furthermore, a stir stick 38 may be included in the storage area 26 of the ice container 24. The stir stick 38 is configured to rotate and/or oscillate to move the ice cubes towards the ice aperture 32 and also to prevent the formed ice cubes from melting and freezing to one another such that a large block of ice is formed within the ice container 24. However, it should be appreciated that the stir stick 38 can take other forms, and also need not be required in all embodiments.

As discussed, FIGS. 3-5 include a crushing assembly 40 positioned generally adjacent the storage area 26 of the ice container 24. The crushing assembly 40 is shown to be positioned at the discharge zone 36 of the ice container 24, such that ice passing from the storage area 26 through the discharge zone 36 can be selectively crushed by the crushing assembly 40. However, it should be appreciated that not all the ice moved from the storage area through the discharge zone need be crushed. Instead, a user may selectively decide to dispense fully formed ice or crushed ice from the dispenser based upon a user interface (not shown) at the dispenser 20 on the door 17 of the refrigerator 10.

The crushing assembly 40 shown in the figures comprises a plurality of fixed crushing blades 42 having blade teeth 44 thereon, and a plurality of rotating crushing blades 46 having rotating blade teeth 48 thereon. As shown best in FIGS. 3 and 5, the fixed blades 42 and the rotating blades 46 are alternated along the height of the discharge or crushing zone 36. The alternating of the blades in the crushing assembly 40 provides for a better chance that a formed ice cube will be crushed through the zone 36 and will not be dispensed as a whole cube. The teeth 44, 48 of the blades 42, 46 also provide for better crushing mechanisms such that they will crush the hardened, formed ice cubes. A motor 52 is connected to the stir stick 38, as well as the rotating crushing blades 46 to provide rotation thereof. The stir stick 38 and the crushing blades 42, 46 may all share a common axis such that the components are rotated about the common axis. In addition, the stir stick may include separate rotating means, such as a cam, gear, or other component, such that it need not rotate when the crushing assembly is activated. Furthermore, when the crushing assembly 40 is not activated, the stir stick 38 may still be separately rotated such that it breaks up ice in the storage area 26 of the ice container 24, while not crushing the ice passing therethrough and to the dispenser 20.

As best shown in FIG. 4, the ice aperture 32 comprises a wall having a wall perimeter 50 or diameter. The diameter of the wall perimeter 50 may be larger than the length of the rotating crushing blades 46. This creates a gap, shown as the arrow 58 in FIG. 4. When the ice maker 22 of the refrigerator 10 is configured to produce non-crescent shaped cubes, or other smaller shaped cubes, this gap 58 may be large enough such that cubes can pass through without being crushed by the crushing assembly 40. Therefore, the present invention provides for a diverter wedge 60 to be attached to or formed integrally with the fixed crushing blades 42 of the crushing assembly 40.

The diverter wedge 60 as shown in the figures comprises an arcuate or sloped portion 62 at a forward end 64 of the wedge 60, and an attachment area or base area 66. When the diverter wedge 60 is a separate component than the fixed crushing blades 42, the attachment portion 66 may include a plurality of slots 68 corresponding with the number of fixed crushing blades 42 along the height of the crushing assembly 40 and an edge 56 of the fixed blades 42 can be inserted into the slots 68 of the diverter wedge 60 and either temporarily or permanently affixed therein. However, as mentioned, the diverter wedge 60 may also be formed integrally with the fixed crushing blades 42 such that the blades and the wedge comprise one singular piece that is attached to the rest of the crushing assembly 40.

The fixed crushing blades 42 and diverter wedge 60 do not rotate during crushing or non-crushing uses of the ice container. In addition, the diverter wedge 60 extends generally from the floor 28 of the ice container 24 to the bottom of the discharge zone 36. Thus, the diverter wedge 60 extends along the full height of the fixed and rotating crushing blades 42, 46. Therefore, the diverter wedge 60 for use with the crushing assembly 40 of the present invention works as follows. Ice is formed in the ice maker 22 and ejected into the storage area 26 of the ice container 24. When a user chooses to dispense ice from the dispenser 20, the user also selects whether to have the formed ice cubes crushed. If the ice cubes are not to be crushed, the crushing assembly 40 is not activated, and the cubes are allowed to pass through the discharge zone 36 in full configuration.

However, when it is desired that the cubes be crushed, the crushing assembly 40 is activated prior to opening the aperture 32 to allow ice to pass from the storage area 26 to the discharge zone 36. The rotating crushing blades 46 begin to rotate in the direction generally shown by the arrow 70 in the figures. It should be noted that the direction of rotation coincides with the front face of the teeth 48 of the blades 46. The fixed blades 42 include teeth 44 that are oriented to generally opposite that of the rotating crushing blades such that the ice cubes will be crushed between the mating teeth of the blades 42, 46.

When the formed cubes are non-crescent shape, or are smaller in size, they may move generally outward towards the wall perimeter 50 of the discharge zone 36, which would move them outside the outer edge of the rotating crushing blades 46. However, the arcuate or sloped portion 62 of the diverter wedge 60 will block the cubes from passing through the crushing assembly 40 without being crushed and will kick the cubes in the direction generally shown by the arrow 72 of the figures back towards the center or axis of the blades such that the cubes will be forced between the mating teeth of the fixed and rotating crushing blades 42, 46. Therefore, the diverter wedge 60 according to the present invention provides better efficiency of crushing different size and shape configurations of ice cubes. The diverter wedge 60 will ensure that the ice is crushed when so desired.

Other options may be included with the ice container 24. For example, stir stick 38 may be configured to rotate and/or oscillate such that the ice cubes are not clumped together before passing through the discharge zone 36 of the crushing assembly 40. In addition, while the figures show that the rotating crushing blades 46 may include different lengths extending from the axis thereof, the diverter wedge may have a changing thickness along its height to correspond for this difference in length of the blades. For example, as shown in FIG. 3, the rotating blades are shown to be shorter as moving from top to bottom. Therefore, it is contemplated that the diverter wedge 60 will get wider at the lower end thereof to accommodate or account for this shorter rotating blade length. However, it is also contemplated that the diverter wedge 60 includes a generally uniform width or thickness along the height of the wedge. In addition, as stated above, it is contemplated that the diverter wedge 60 either be a separate component that is attached to the fixed crushing blades 42, or that it be integrally formed with the fixed blades such that the form one single piece.

Figure 6:
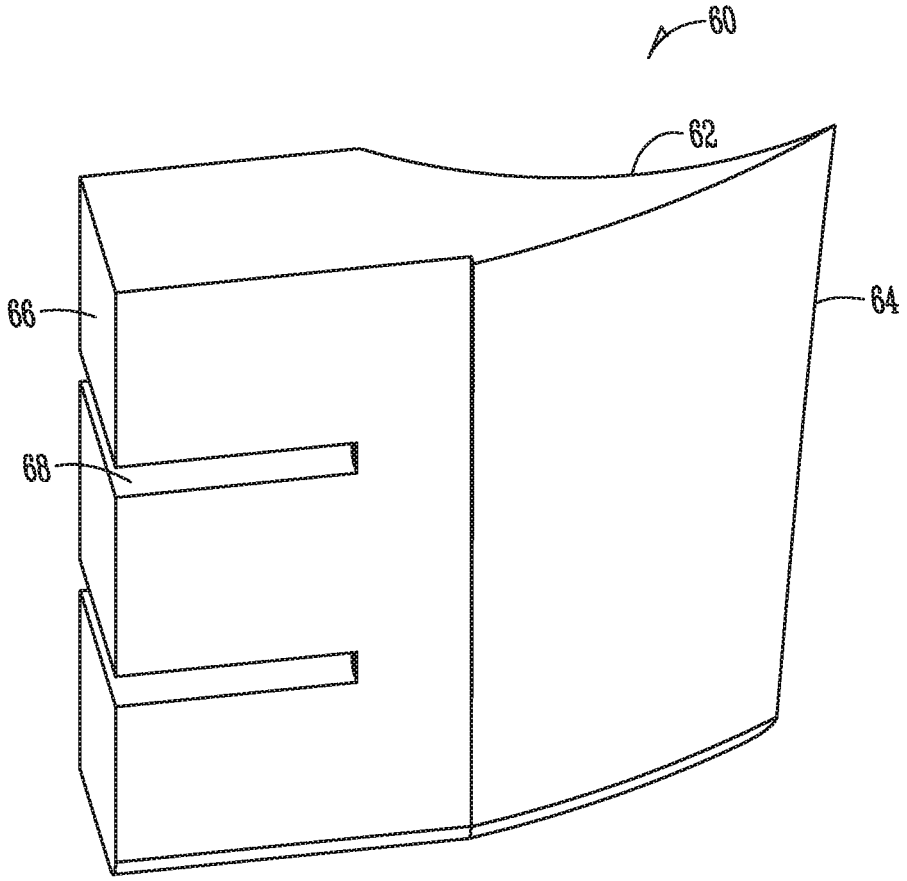
FIG. 6 is a perspective view of a diverter wedge according to an embodiment of the present invention.
Figure 7:
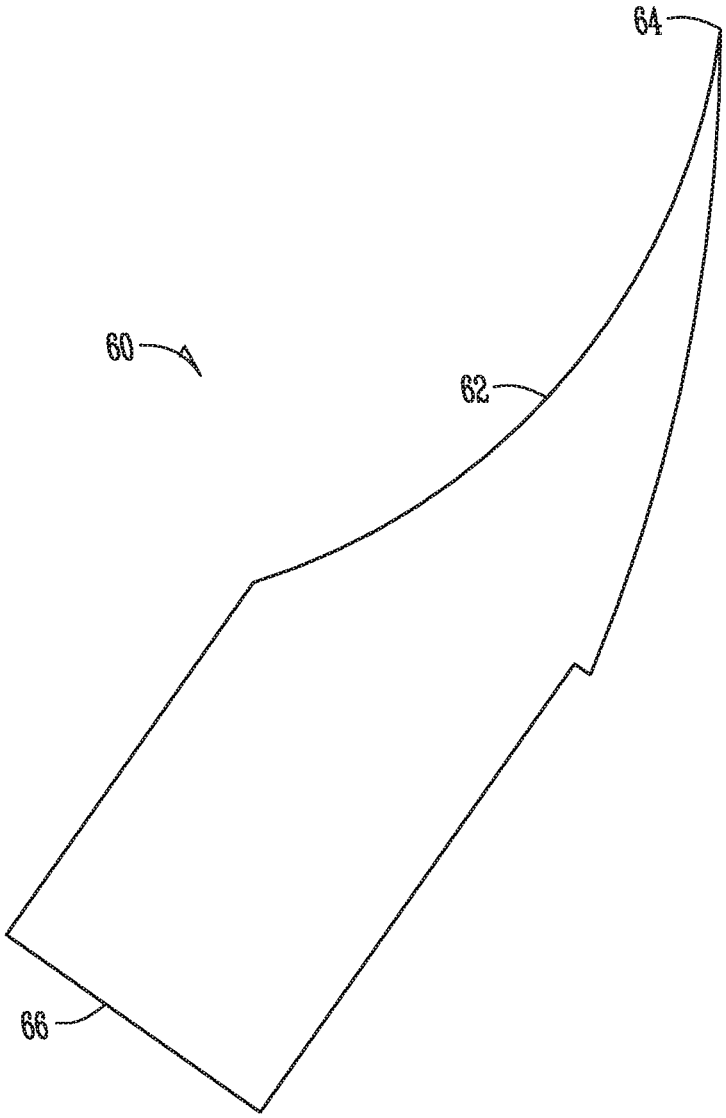
FIG. 7 is a top plan view of the diverter wedge of FIG. 6.

FIGS. 6 and 7 are perspective and top plan views of an embodiment of the diverter wedge 60 according to an exemplary aspect of the present invention. As state, the diverter wedge 60 can include a sloped or arcuate portion 62 at generally the forward end 64 of the wedge 60. At the opposite end is an attachment portion 66. The attachment portion 66 is thicker to account for the gap 58 as discussed above. In addition, the attachment zone 66 may include a plurality of slots 68 matching the number of fixed crushing blades 42. Thus, the diverter wedge 60 may be selectively added to the crushing assembly 40 by simply inserting the fixed crushing blades through the slots 68 of the diverter wedge 60. The arcuate or sloped portion 62 allows ice cubes to be easily moved along the sloped portion 62 such that the cubes are moved towards the center of the crushing assembly 40 between the rotating and fixed crushing blades. The gentle slope and curvature of the arcuate portion provides for an efficient way to move the cubes without causing the cubes to become blocked or positioned between the blades in a manner that prevents the crushing blades from rotating.

Other aspects of the diverter wedge may be varied according to use with types, sizes, and configurations of ice cubes. For example, the size of the diverter wedge 60 may be varied according. In addition, as mentioned above, the width may be generally uniform along the height of the diverter wedge, or may be tapered one way or the other to account for a varying thickness of the gap 58 between the rotating blades and the outer wall of the discharge zone. It is contemplated that the diverter wedge comprises a plastic or other rigid material that may be molded. The molded plastic diverter wedge 60 will provide a sturdy component for aid in crushing ice cubes, while being relatively easily to manufacture. The molding of the diverter wedge will also allow for various other changes to be changed according to the type of refrigerator, type of ice assembly, type of storage container, type of ice cubes, and the like. Therefore, the present invention contemplates that other variations to the diverter wedge be contemplated as part of the present invention. The diverter wedge shown in the figures is but an exemplary embodiment of the diverter wedge 60.

The foregoing description has been presented for purposes of illustration and description, and is not intended to be an exhaustive list or to limit the invention to the precise forms disclosed. It is contemplated that other alternative processes obvious to those skilled in the art are considered to be included in the invention. The description is merely examples of embodiments. It is understood that many other modifications, substitutions, and/or additions may be made, which are within the intended spirit scope of the invention. From the foregoing, it can be seen that the present invention accomplishes at least all of the stated objectives.

What is claimed is:

1. A refrigerator, comprising:

a cabinet, an ice container positioned within the cabinet; and a crushing assembly operatively connected to the ice container, the crushing assembly comprising a plurality of fixed crushing blades, a plurality of rotating crushing blades positioned adjacent the fixed crushing blades, and a fixed diverter wedge positioned at an edge of the fixed crushing blades and surrounding at least a portion of the fixed crushing blades, the diverter wedge configured to divert cubes towards the crushing blades;

said diverter wedge including a sloped portion with a surface extending along a height that is generally orthogonal to a side portion of one of the fixed crushing blades and said sloped portion ending in an end portion extending between an outer portion of the rotating crushing blades and a wall at or near the fixed crushing blades, the end portion sized to substantially eliminate a gap between an outer edge of the rotating crushing blades and the wall as the rotating blades approach the fixed crushing blades.

2. The refrigerator of claim 1 wherein the sloped portion of the diverter wedge comprises a sloped surface that is oriented wherein the surface extends along a height that is generally parallel to an axis of rotation of the plurality of rotating crushing blades.

3. The refrigerator of claim 2 wherein the diverter wedge further comprises a separate part that is removably attached to the fixed blades to allow for different sized wedges.

4. The refrigerator of claim 3 wherein the diverter wedge further comprises an attachment portion for attaching the wedge to the fixed blades.

5. The refrigerator of claim 2 wherein the diverter wedge is integrally formed with the crushing assembly.

6. The refrigerator of claim 2 wherein the portion of the diverter wedge that extends a distance substantially between that of the distance between first and second outermost crushing blades of the crushing assembly and the wall comprises an attachment portion.

7. The refrigerator of claim 1 further comprising a stir stick positioned adjacent the crushing assembly in the ice container to aid in the movement of ice.

8. The refrigerator of claim 1 wherein the ice container comprises a storage area comprising a floor having an aperture therein defining a discharge zone that is at least partially covered by a lid.

9. The refrigerator of claim 8 wherein the crushing assembly is positioned in the discharge zone of the ice container adjacent the storage area.

10. The refrigerator of claim 9 wherein the lid includes an opening to allow ice cubes to pass from the storage area to the discharge zone.

11. A refrigerator, comprising:

a cabinet;

at least one compartment within the cabinet;

at least one door providing access to within the compartment;

an icemaker positioned within the compartment;

an ice container positioned adjacent the icemaker; and a crushing assembly positioned within the ice container and comprising a plurality of fixed crushing blades and a plurality of rotating crushing blades alternated in the ice container;

the plurality of fixed blades including a fixed diverter wedge positioned at an edge of the fixed crushing blades and surround at least a portion of the fixed crushing blades, the diverter wedge configured to divert cubes towards the crushing blades;

said diverter wedge including a sloped portion with a surface extending along a height that is generally orthogonal to a side portion of one of the fixed crushing blades and said sloped portion ending in an end portion extending between an outer portion of the rotating crushing blades and a wall at or near the fixed crushing blades, the end portion sized to substantially eliminate a gap between an outer edge of the rotating crushing blades and the wall as the rotating blades approach the fixed crushing blades.

12. The refrigerator of claim 11 wherein the compartment is a refrigerator compartment.

13. The refrigerator of claim 12 further comprising a dispenser at the at least one door to dispense ice from said dispenser at said at least one door.

14. The refrigerator of claim 13 wherein the ice container comprises a storage area and a discharge zone in an aperture adjacent the storage area.

15. The refrigerator of claim 14 wherein the crushing assembly is positioned within the discharge zone of the ice container.

16. The refrigerator of claim 15 wherein the sloped portion is an arcuate shape.

17. An ice container, comprising:

a storage area defined by a floor and walls extending from the floor;

a crushing assembly positioned within the storage area comprising a plurality of fixed crushing blades and a plurality of rotating crushing blades alternated along the height of the crushing assembly; and a fixed diverter wedge extending along the height of the blades and positioned at an edge of the fixed crushing blades and surrounding at least a portion fixed crushing blades, the diverter wedge configured to divert cubes towards the crushing blades;

said diverter wedge including a sloped portion with a surface extending along a height that is generally orthogonal to a side portion of one of the fixed crushing blades and said sloped portion ending in an end portion extending between an outer portion of the rotating crushing blades and a wall at or near the fixed crushing blades, the end portion sized to substantially eliminate a gap between an outer edge of the rotating crushing blades and the wall as the rotating blades approach the fixed crushing blades.

18. The ice container of claim 17 wherein the sloped portion of the diverter wedge extends from the blades.

19. The ice container of claim 18 wherein the sloped portion is an arcuate shape.

20. The ice container of claim 17 wherein the diverter wedge is formed integrally with either the blades or the storage area of the ice container.

* * * * *